US012383035B2

(12) United States Patent
Sanchez

(10) Patent No.: US 12,383,035 B2
(45) Date of Patent: Aug. 12, 2025

(54) SELF-SUPPORTING SHADE AND KIT FOR ELECTRONIC DEVICES

(71) Applicant: Kalley Sanchez, Monterey Park, CA (US)

(72) Inventor: Kalley Sanchez, Monterey Park, CA (US)

( * ) Notice: Subject to any disclaimer, the term of this patent is extended or adjusted under 35 U.S.C. 154(b) by 335 days.

(21) Appl. No.: 18/335,616

(22) Filed: Jun. 15, 2023

(65) Prior Publication Data

US 2024/0415247 A1 Dec. 19, 2024

(51) Int. Cl.
*G06F 1/16* (2006.01)
*A45B 23/00* (2006.01)

(52) U.S. Cl.
CPC ..... *A45B 23/00* (2013.01); *A45B 2023/0006* (2013.01); *A45B 2023/0093* (2013.01)

(58) Field of Classification Search
CPC ..... A45B 23/00; A45B 2023/0006; A45B 2023/0093
See application file for complete search history.

(56) References Cited

U.S. PATENT DOCUMENTS 2,109,881 A * 3/1938 Goldberg ..... A47G 9/062 135/117
4,082,102 A * 4/1978 Heuer ..... E04H 15/003 135/120.2
4,295,481 A * 10/1981 Gee ..... E04H 15/58 135/96
4,491,435 A * 1/1985 Meier ..... F16M 11/2078 403/56
5,033,528 A * 7/1991 Volcani ..... F16M 11/40 403/56
5,137,072 A * 8/1992 Traspadini ..... B60J 1/2063 160/370.22
5,641,191 A * 6/1997 Jia ..... F16M 11/2078 403/90
5,752,537 A * 5/1998 Kranzler ..... E04H 15/003 135/900
9,175,496 B2 * 11/2015 Darquea ..... E04H 15/003
9,351,415 B2 * 5/2016 Zaccaria ..... H04B 1/3888
10,963,010 B1 * 3/2021 Griffin ..... G02B 27/0018
12,135,582 B1 * 11/2024 Manthei ..... G06F 1/1603
2013/0148204 A1 * 6/2013 Allen ..... G02F 1/133502 359/601

(Continued)

*Primary Examiner* — Christopher E Leiby
(74) *Attorney, Agent, or Firm* — Omni Legal Group; Omid E. Khalifeh; Ariana Santoro

(57) ABSTRACT

A free-standing shade comprising a self-supporting base, an at least partially opaque shield, and means for removably securing the shield to the base, and an assembly including the same, are provided. The base comprises a first plate and a second plate extending at an angle from a rear edge of the first plate, where the first plate is sized to support an object, such as an electronic device or even DJ equipment, to be shaded thereon. The securement means may be disposed on an inside of the second plate along a forward edge of such plate and is operative to suspend the shield at an angle over any of the base to provide shade over the supported object. The securement means may be configured as two horizontal bars spaced apart from each other to engage an edge of the shield and permit rapid assembly and dismantling of the shade.

13 Claims, 4 Drawing Sheets

(56) References Cited

U.S. PATENT DOCUMENTS

| | | | | |
|---|---|---|---|---|
| 2015/0288319 | A1* | 10/2015 | Hartman | H02S 20/30 136/246 |
| 2017/0279478 | A1* | 9/2017 | Fathollahi | H04B 1/3877 |
| 2017/0279944 | A1* | 9/2017 | Gander | H04M 1/04 |
| 2017/0322590 | A1* | 11/2017 | Jacobs | H04M 1/026 |
| 2019/0297178 | A1* | 9/2019 | Gander | H04M 1/215 |
| 2023/0363560 | A1* | 11/2023 | Scott | E04B 1/3445 |

* cited by examiner

SELF-SUPPORTING SHADE AND KIT FOR ELECTRONIC DEVICES

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to shades, and, more particularly, to protective sun covers for electronic devices that may be readily engaged or disengaged as needed or desired.

BACKGROUND

Coachella, Stagecoach, Ultra, and Lollapalooza, are just a few well-known music festivals drawing crowds of thousands annually. These festivals are often all-day, outdoor events, starting during the day and lasting until well into the night, creating a dynamic and immersive experience for attendees. While the extended festival day is exciting and enjoyable to most attendees, it can present challenges to the staff and crew who have to ensure equipment is protected from changing conditions.

Currently, many DJs and other sound professionals protect their equipment through the use of temporary shade structures, such as umbrellas and pop-up tents. However, umbrellas, pop-up tents, and other similar temporary structures are bulky, time-consuming to set up and take down, inefficient, and can even obscure the DJ from view. These temporary structures often provide the shading surface from several feet over the desired area. This means that not only is sensitive equipment inadequately protected from elements such as dust, rain, or accidental spills, but it also requires constant adjustment to maintain the shade over a targeted area, such as over the DJ's turn table, mixers, soundboard, laptop computer, smart phone and the like as the sun changes position throughout the event. This distracts from the event itself, as attendees, and even the DJs, get distracted by the constant adjustment necessary to protect the equipment from the sun. Consequently, there is a need for an improved shading mechanism that can be rapidly assembled to provide consistent shade to a desired area and rapidly dismantled without disturbing any items placed within the desired area.

One proposal for a sun shade is U.S. Pat. No. 10,963,010 to Griffin, which teaches a foldable, three panel light shade mounted along the edges of a laptop computer screen using clips. Another proposal is found in U.S. Pat. No. 9,310,615 to Allen, which teaches a foldable sun blocking and privacy hood. Both of these depend on a vertical component to provide structural support to the shade. The need for vertical support offered by the electronic device to be used severely limits its applicability. Indeed, many soundboards and other sound equipment-especially those used at music events-require vertical clearance to permit the user to access any touchscreens and/or controls in the form of knobs, dials, and slides. As the current proposals require the electronic device itself to provide vertical support for the shade, they are unsuitable for many types of sound equipment. Further, these proposals comprise lateral supports, which create a barrier between adjacent devices. This severely limits the ability to rapidly access various devices and limits their usability to only devices that fall within a predetermined size. As a result, these proposals cannot accommodate a wide range of uses and devices.

There remains a need for self-supporting shades configured to accommodate a wide range of devices and equipment that can be rapidly assembled and dismantled.

SUMMARY

The present disclosure is directed to a low-profile shade comprising a base, shield, and a securement means, wherein the securement means is operative to suspend the shield from the base to provide shade over at least a portion of such base. More particularly, the present disclosure is directed to a low-profile sun cover that may be rapidly assembled to selectively provide shade and further dismantled without the need for specialized tools or otherwise disturbing any object, such as an electronic device, positioned on the base. The electronic device may be any electronic device, such as a turn table, mixer, soundboard, laptop or tablet computer, smart phone, and the like. While the disclosure will be described in connection with the electronic device, a person of ordinary skill will recognize that any object may be shaded and the reference to the electronic device is in the interest of brevity.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In one embodiment, the base comprises a first plate and a second plate extending upward at an angle from a rear edge of the first plate. In some embodiments, the second plate may extend off the rear edge of the first plate at an outward angle greater than 90°. Of course, in other embodiments the second plate may extend off the rear edge at about a 90° angle or inwards towards the first plate.

In one embodiment, the securement means may be integrated on or applied to the base. More particularly, the securement means may be disposed on the second plate in a manner operative to suspend any of the shield over any of the first plate. Of course, in another embodiment, the securement means may be integrated on or applied to the shield. Indeed it is even contemplated that the securement means may be an independent structure operative to securely engage the base and the shield with one another.

In some embodiments, the shield may engage with the second plate at about a ninety-degree angle relative to the second plate. As the second plate, in some embodiments, extends outward from the first plate at an angle greater than 90°, the shield may be suspended at an upward angle relative to the first plate. This arrangement may enable viewing of the electronic device from an elevated position. It is further contemplated that the arrangement may permit viewing of a top surface of the electronic when the shield is secured. In another embodiment, the shield may engage with the second plate at an angle greater than 90°, which one of ordinary skill in the art will recognize may even further increase the visibility of any top surface of the electronic from an elevated position when the shield is secured.

The securement means may be any means operative to securely engage the shield with the base at a fixed angle. In one embodiment, the securement means may be operative to removably secure the shield to the base using a friction fit. The friction fit may be configured in any manner a person of ordinary skill in the art may desire. In one embodiment, the securement means may comprise two horizontal bars spaced apart from each other operative to engage with an edge of the shield. In some embodiments, such horizontal bars may comprise a rubberized, felt, or other lining operative to effectuate the exemplary friction fit. In an embodiment, the securement means may disposed on an inside of the second plate along a forward edge of the second plate and positioned to suspend the shield at an angle configured to permit at least some vertical visualization of an object, such as the electronic device, situated on the first plate. In another embodiment, the securement means may be configured as a slot extending across any of the inner surface of the second plate. Of course, other securement means may be utilized, such as magnets, clips, clasps, hooks, fasteners, brackets, adhesives, hook and loop fasteners, and the like, and the aforementioned are provided as non-limiting examples only. In some embodiments, a combination of securement means may be utilized.

Any of the sun cover may be formed of an at least partially opaque material, operative to reduce direct light to the electronic device. For example, at least any of the shield may be configured at least partially opaque to provide a removable shade over the electronic device.

Several advantages of the shade and assembly are that they:

(a) create a self-supporting shade for use with electronic devices;

(b) permit a plurality of sun covers to be utilized in combination with one another to create a laterally continuous shading structure;

(c) protects electronic components, such as devices and wires, from access and debris via members in an audience situated opposite any user of the assembly and electronic device; and (d) expands the user's field of view of and access to shaded devices over certain alternative sun protection devices.

Thus, it is an object of this invention to provide a low-profile shade for electronic devices.

It is another object of the invention to provide a shade that may be rapidly assembled.

It is a further object of this invention to provide a removable shield that may be rapidly dismantled without disturbing any electronic devices shaded by the shield.

It is still a further object of the invention to suspend the shield in a manner operative to permit vertical viewing of and access to the object to be shaded.

It is yet another object of the invention to provide a shade that can be abutted with others to provide continuous shade over a greater lateral area.

One or more of the above-disclosed embodiments, in addition to certain alternatives, are provided in further detail below with reference to the attached figures. The disclosed subject matter is not, however, limited to any particular embodiment disclosed.

Figure 1:
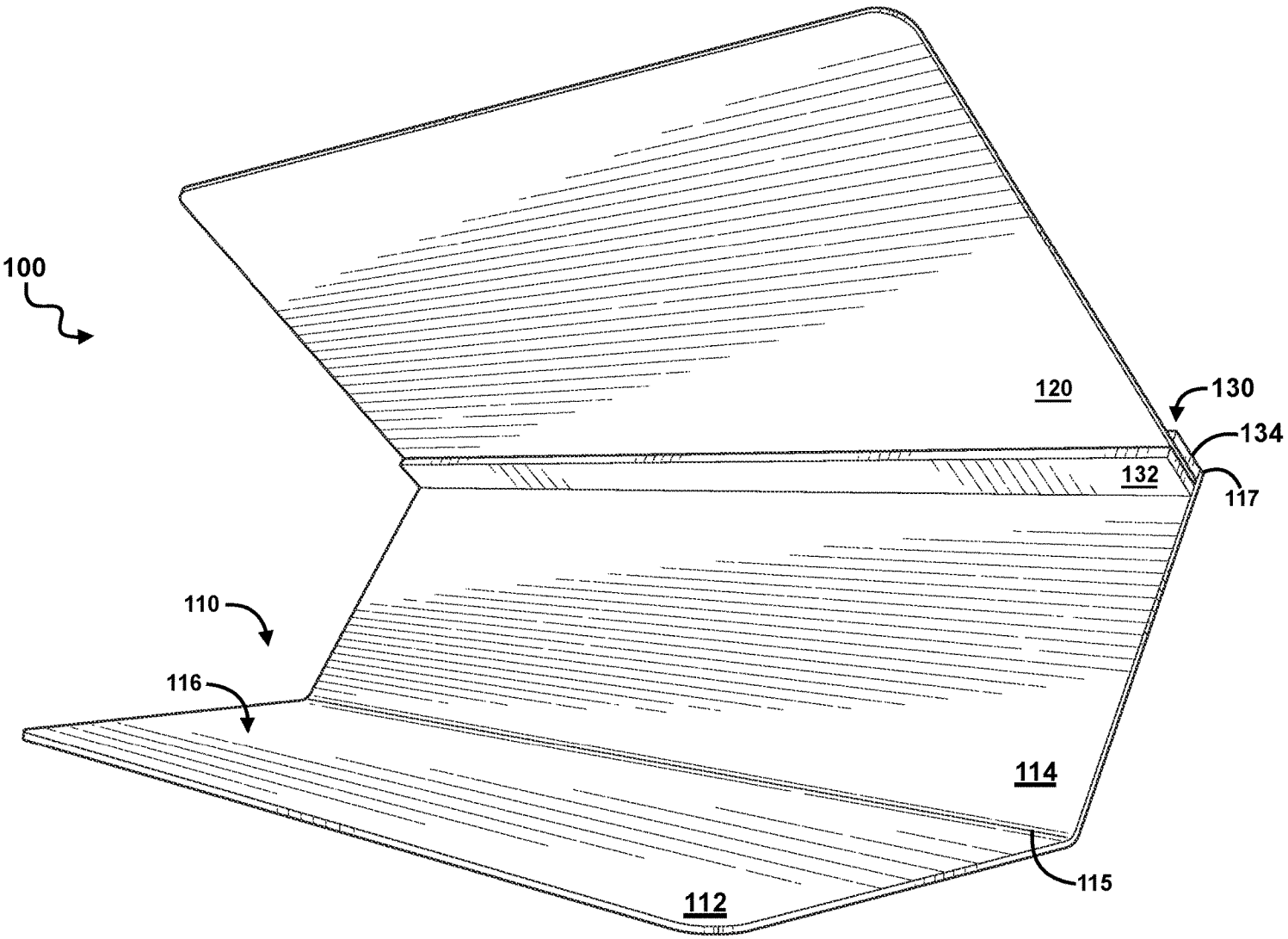
FIG. 1 shows a front perspective view of an embodiment of the shade.

The disclosed embodiments may be better understood by referring to the figures in the attached drawings, as provided below. The attached figures are provided as non-limiting examples for providing an enabling description of the method and system claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

Figure 2:
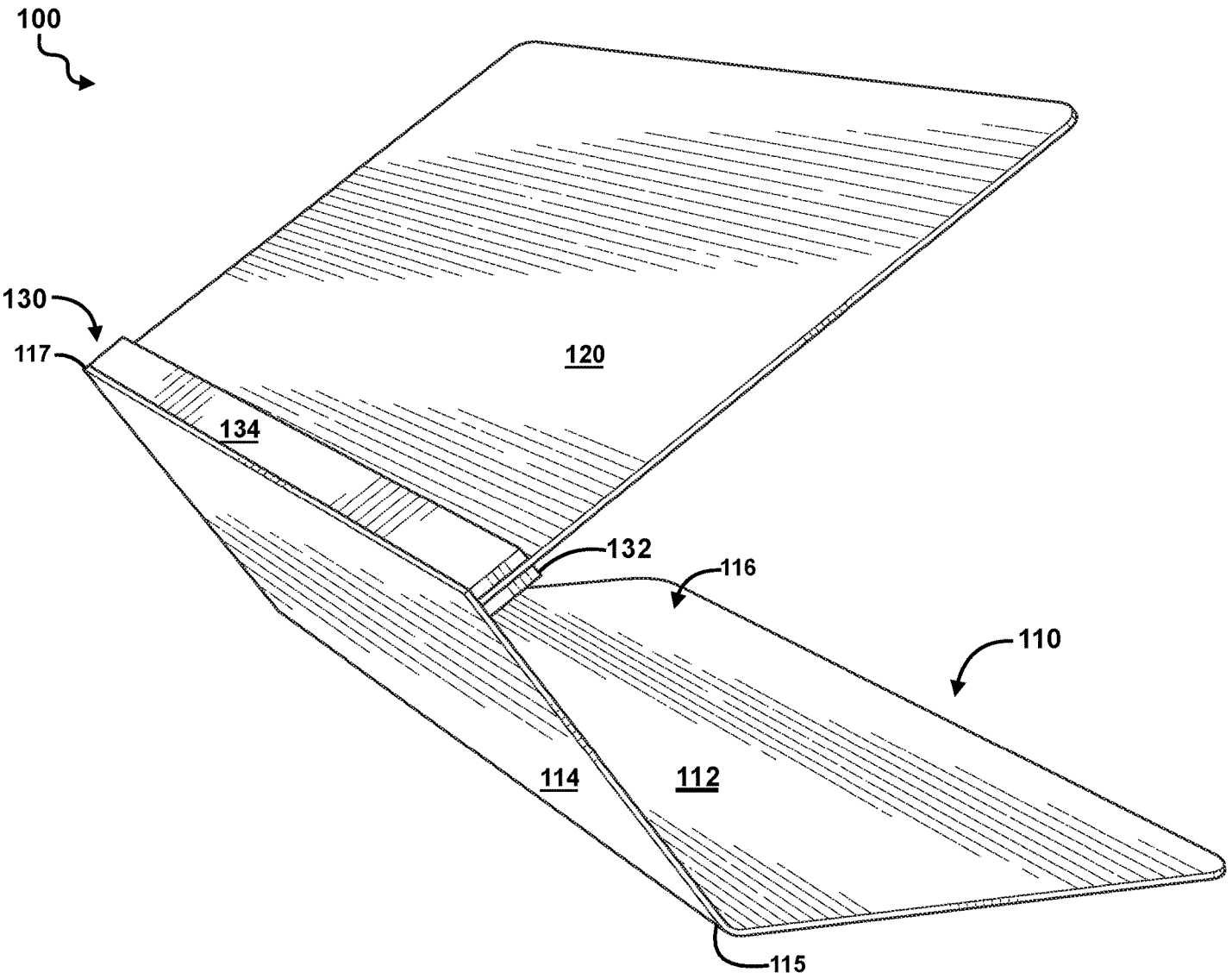
FIG. 2 shows a rear perspective view of an embodiment of the shade.
Figure 3:
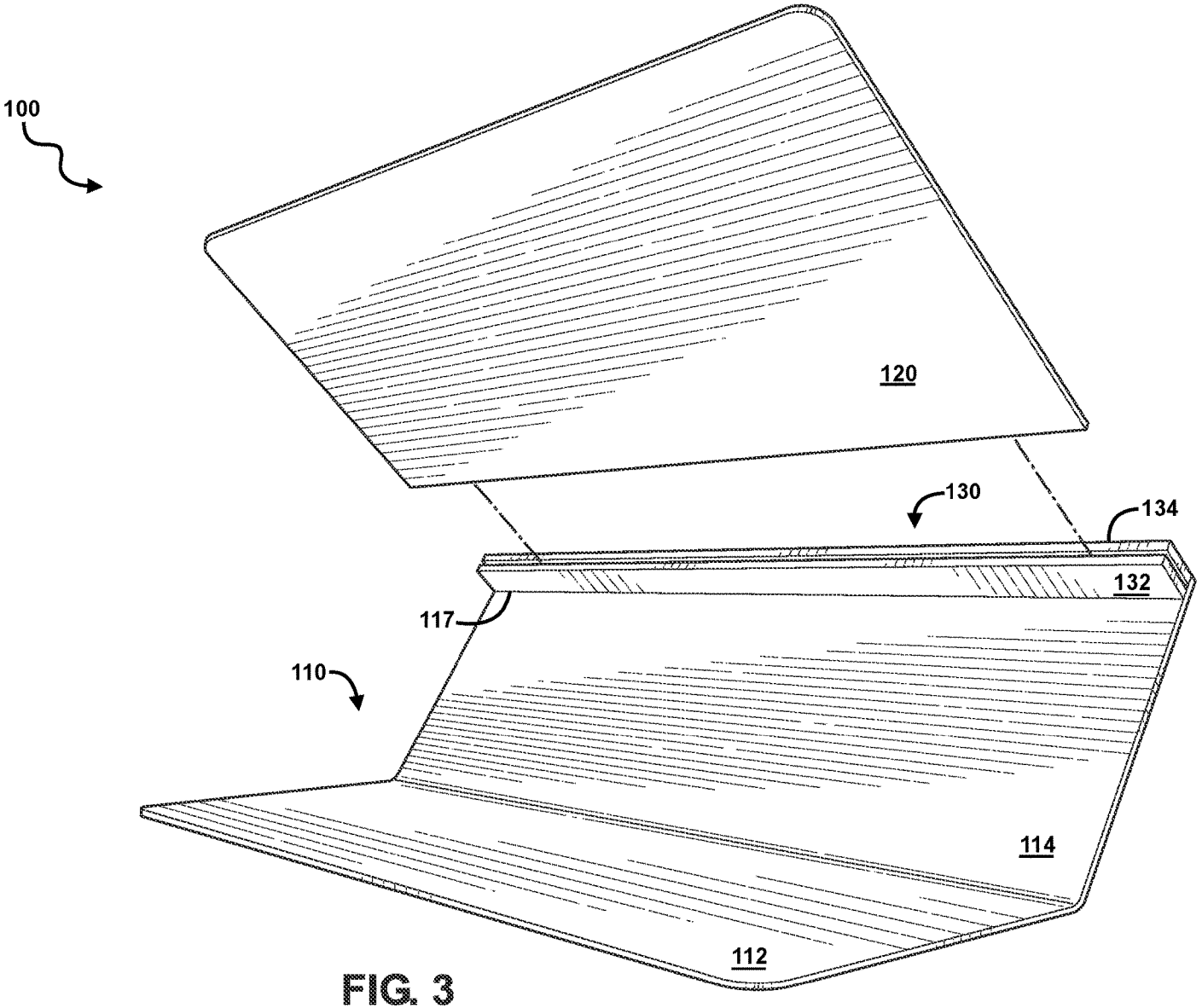
FIG. 3 shows a front exploded perspective view of an embodiment of the shade.
Figure 4:
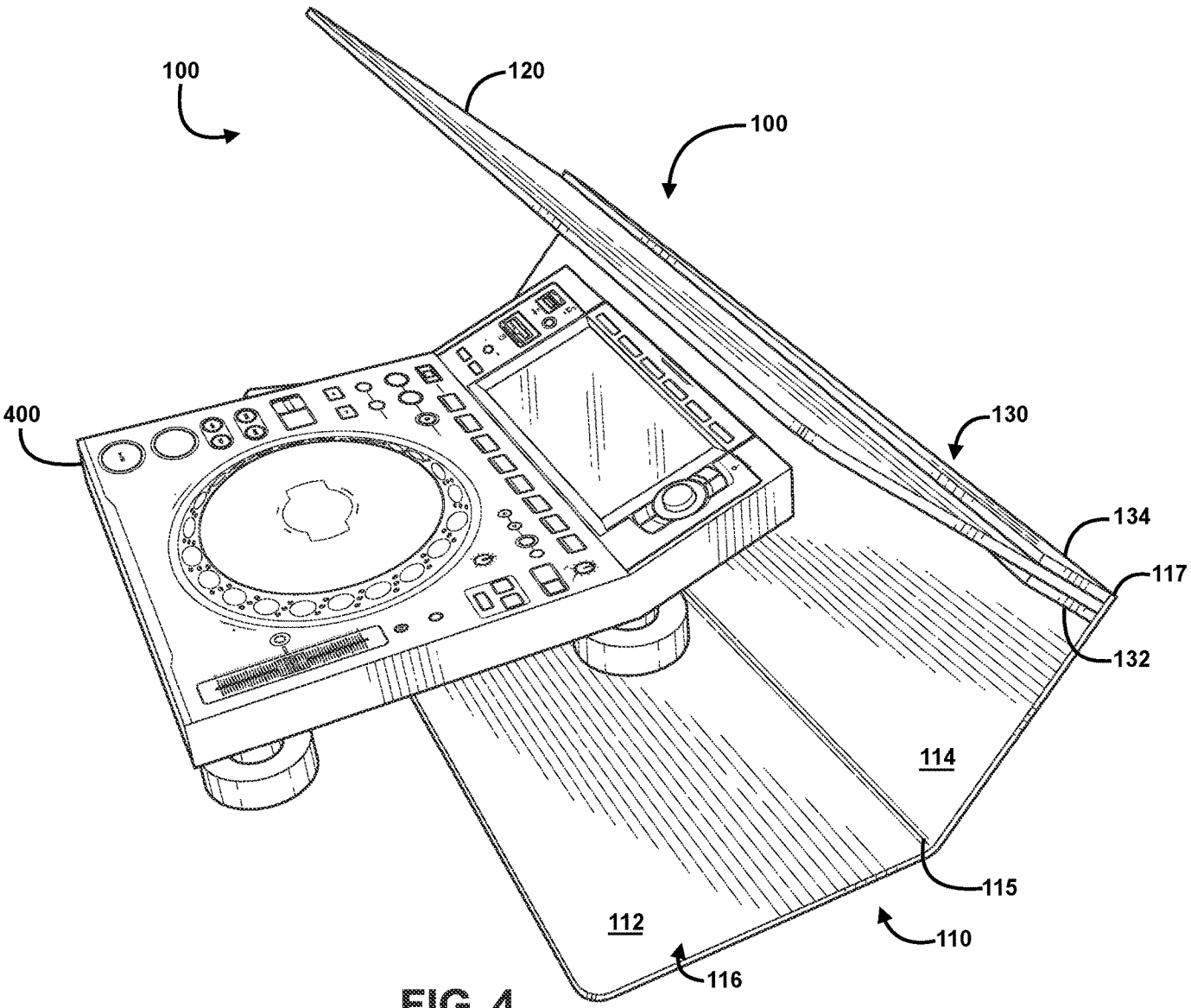
FIG. 4 shows a side perspective view of an embodiment of the shade in use.

With reference to FIGS. 1-4, one embodiment of a sun cover 100 may comprise a self-supporting base 110, and a securement means 130 configured to removably secure with a sun shield 120. FIG. 4 provides one example of the sun cover 100 in use with an exemplary object to be shaded is provided as an electronic device 400. The electronic device 400 shown is configured as a media player, however, any electronic device may be utilized. For example, computers, tablets, electronic interfaces, switchboards, soundboards or mixers, or any other device that a person of ordinary skill may desire.

With reference to FIGS. 1-2 in particular, the base 110 may comprise a first plate 112 and a second plate 114 extending off an edge of the first plate 112. The first plate 112, may be sized to receive any portion of an electronic device, such as exemplary electronic device 400 in FIG. 4, and may be configured to anchor the sun cover 100 in place.

Returning to FIGS. 1 and 2, the second plate 114 may extend off a rear edge 115 of the first plate 112 at an outward angle relative to an inner surface 116 of the first plate 112. In some embodiments, the angle between the first plate 112 and the second plate 114 may be from about 45° to about 165°. For example, the second plate 114 may extend off the first plate 112 at an angle from about 90° to about 135°. Of course, the second plate 114 may extend off the rear edge 115 of the first plate 112 at any angle a person of ordinary skill in the art may desire. The sun cover 100 may be sized to accommodate any electronic device 400. In one embodiment, the sun cover 100 may be sized to accommodate electronic devices 400 having a height of less than about thirty-six inches.

In some embodiments, the base 110 may have a width from about six inches to about forty-eight inches. In some embodiments, the base 110 may have a width from about sixteen inches to about thirty inches. A person of ordinary skill will recognize that the particular width of the base 110 will not limit the size of the electronic device 400 to be shaded. It is contemplated that a plurality of sun covers may be sequentially abutted along a lateral edge to accommodate electronic devices of greater width. In some embodiments, the shield 120 may have a width of about equal to the width of the base 110. In other embodiments, the shield may have a width of less than or greater than the width of the base. It is contemplated that the shield having a width different than the width of the base may permit the sun cover to accommodate varying types and styles of electronic devices. Further, the shield, having any width, may be operative to secure a plurality of abutting bases to each other to form. A person of ordinary skill in the art will recognize that a plurality of sun covers may be aligned with one another along a lateral edge of the bases to create a continuous sun cover. It is contemplated that aligning the plurality of sun covers along the lateral edges may permit the plurality of sun covers to accommodate electronic devices of various sizes or even a plurality of electronic devices.

With reference now to FIG. 3, the securement means 130 may be located on the second plate 114 of the base 110. More specifically, the securement means 130 may be aligned with a forward edge 117 of the second plate 114. As shown in FIGS. 1, 2, and 4, the securement means 130 may be operative to suspend the shield 120 at about a 90° angle relative to the second plate 114. In FIG. 4 in particular, the second plate 114 extending off the first plate 112 at an outward angle relative to an inner surface 116 of the first plate 112 is operative to suspend the shield 120 upwards relative to the first plate 112. This may permit the electronic device 400 to be viewed from above, permitting use of the sun cover 100 with a large range of digital interfaces. Of course, in other embodiments, the securement means 130 may suspend the shield at any angle relative to the first and second plates.

Returning to FIG. 3, the securement means 130 may be configured as a first horizontal bar 132 and a second horizontal bar 134 spaced apart from each other to securely engage an edge of the shield 120. The first horizontal bar 132 may be parallel to the forward edge 117 of the second plate 114, and the second horizontal bar 134 may be parallel to the first horizontal bar 132. The distance between the first horizontal bar 132 and the second horizontal bar 134 may be defined by an edge of the shield 120. It is contemplated that the first horizontal bar 132 and the second horizontal bar 134 being spaced apart from each at a distance about equal to the edge of the shield 120 may permit the shield 120 to removably secure to the base 110.

Of course, in other embodiments, not shown, any suitable securement means may be utilized. For example, and without limitation, the securement means may comprise a slot, magnets, clips, clasps, hooks, fasteners, brackets, latches, adhesives, Velcro, or any other suitable attachment means. The securement means may further comprise additional elements, such as a rubberized lining, felt lining, and the like, operative to improve securement of the shield 120 therein.

In addition, the shield 120 may be substantially rectangular in shape wherein at least one edge is configured to removably secure with the securement means 130. Of course, other shapes may be utilized, and the aforementioned is provided as a non-limiting example only. In some embodiments, not shown, each corner on the shield may be rounded and any edge may be configured to removably secure to the securement means. In other embodiments, such as the embodiment shown in FIG. 3, the corners corresponding with the edge of the shield 120 engage to the securement means 130 may be sharp.

The shield 120 being operative to removably secure with the forward edge of the second plate 114 may permit the shield 120 to be removed during use. Permitting the shield 120 to be rapidly secured or removed from the base 110 may render the device beneficially adaptable to changing conditions, such as the setting sun. Further, the shield 120 may secure to the base 110 in a manner to permit removal when shade is no longer desired while avoiding any need to remove of the electronic device 400 from the base 110.

The shield 120 may be at least partially opaque. In one exemplary embodiment, the shield 120 may be fully opaque. It is contemplated that the shield 120, being opaque, may reduce the light permitted to pass through, thereby providing shade. In some embodiments, the base 110 may be at least partially opaque, or in other embodiments, may be fully opaque. It is contemplated that the sun cover 100 being at least partially opaque may reduce direct light, and even heat, on the object to be shaded. In other embodiments, the sun cover 100 may have varying levels of opacity, allowing for at least partial viewing of the electronic device through the shield 120 and/or base 110. It is contemplated that varying levels of opacity (or translucency, as the case may be) may permit the viewing of any of the electronic device 400 or light emitting from the electronic device 400, or even presenting a design on any of the sun cover 100, enhancing the user experience, while reducing radiation to the electronic device 400.

In an embodiment, the sun cover 100 comprises a low thermal conductivity material, such as hard plastic. The hard plastic may be rigid, durable, stable, and have low thermal conductivity. It is contemplated that this may be considered a suitable option to provide shade to electronic devices, such as the electronic device 400 shown in FIG. 4, and may reduce direct heat to the electronic device. Of course, other materials may be utilized, including, without limitation, foam, ceramic, wood, cork, glass, acrylic, or any other material that may be desired.

Indeed, a person of ordinary skill in the art will recognize that media players are often utilized with a plurality of electronic device in order to facilitate the integration of audio and visual content. As a result, the lack of additional supports, such as support from the electronic device itself or lateral supports, may accommodate various configurations and sizes of electronic devices and permit continuous lateral access to the electronic devices.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

CONCLUSIONS, RAMIFICATIONS, AND SCOPE

While certain embodiments of the invention have been illustrated and described, various modifications are contemplated and can be made without departing from the spirit and scope of the invention. For example, the type of objects to be shaded may vary depending on the particular needs and interests of the end user and the sun cover may be adapted to accommodate various types of goods. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the self-supporting shade and kit for electronic devices with which that terminology is associated. In general, the terms used in the following claims should not be constructed to limit the self-supporting shade and kit for electronic devices to the specific embodiments disclosed in the specification unless the above description section explicitly define such terms. Accordingly, the actual scope encompasses not only the disclosed embodiments, but also all equivalent ways of practicing or implementing the disclosed system, method and apparatus. The above description of embodiments of the self-supporting shade and kit for electronic device is not intended to be exhaustive or limited to the precise form disclosed above or to a particular field of usage.

While specific embodiments of, and examples for, the method, system, and apparatus are described above for illustrative purposes, various equivalent modifications are possible for which those skilled in the relevant art will recognize.

While certain aspects of the method and system disclosed are presented below in particular claim forms, various aspects of the method, system, and apparatus are contemplated in any number of claim forms. Thus, the inventor reserves the right to add additional claims after filing the application to pursue such additional claim forms for other aspects of the self-supporting shade and kit for electronic devices.

What is claimed is:

1. A table-top shade configured to protect one or more electronic devices from the sun and other elements comprising:

a self-supporting base having a first plate and a second plate extending at an angle from a rear edge of the first plate;

an at least partially opaque shield; and a securement means configured to removably engage the shield with the forward edge of the second plate at a fixed angle over at least a portion of the first plate.

2. The shade of claim 1, wherein the base is at least partially opaque.

3. The shade of claim 1, wherein the securements means is configured as a slot on an inside of the second plate and operative to engage with an edge of the removable shield.

4. The shade of claim 1, wherein the securement means is configured as two horizontal bars spaced apart from each other and operative to engage with an edge of the removable shield.

5. The shade of claim 1, wherein the first and second plate are bodily integrated with one another along an angled junction corresponding to the rear edge of the first plate.

6. The shade of claim 5, wherein the securement means is disposed on an inside of the second plate along the forward edge of the second plate and positioned to suspend the shield at an angle configured to permit at least some vertical visualization of an object situated on the first plate.

7. The shade of claim 1, wherein the base and shield are plastic.

8. A shade assembly for protecting one or more electronic devices from the sun and other elements comprising:

a self-supporting base having a first plate and a second plate extending at an angle from a rear edge of the first plate, the first plate sized to support an object to be shaded thereon;

an at least partially opaque shield; and a securement means configured to removably engage the shield with the forward edge of the second plate at a fixed angle over at least a portion of the first plate.

9. The shade of claim 8, wherein the base is at least partially opaque.

10. The shade of claim 9, wherein the securement means is disposed on an inside of the second plate along the forward edge of the second plate and positioned to suspend the shield at an angle configured to permit at least some vertical visualization of an object situated on the first plate.

11. The shade of claim 10, wherein the securement means is disposed on an inside of the second plate along the forward edge of the second plate and positioned to suspend the shield at an angle configured to permit at least some vertical visualization of an object situated on the first plate.

12. The shade of claim 8, wherein the securement means is configured as two horizontal bars spaced apart from each other, and operative to engage with an edge of the removable shield.

13. The shade of claim 8, wherein the base and shield are plastic.

* * * * *